US011325760B2

(12) United States Patent
Alderson et al.

(10) Patent No.: US 11,325,760 B2
(45) Date of Patent: May 10, 2022

(54) DIE-CUT LID AND ASSOCIATED CONTAINER AND METHOD

(71) Applicant: Koninklijke Douwe Egberts B.V., Utrecht (NL)

(72) Inventors: Paul Alderson, Banbury (GB); Esak Shabudin, Banbury (GB); Geoff York, Banbury (GB); Egidijus Bartkus, Banbury (GB)

(73) Assignee: Koninklijke Douwe Egberts B.V., Utrecht (NL)

( * ) Notice: Subject to any disclaimer, the term of this patent is extended or adjusted under 35 U.S.C. 154(b) by 8 days.

(21) Appl. No.: 14/745,035

(22) Filed: Jun. 19, 2015

(65) Prior Publication Data

US 2016/0016705 A1 Jan. 21, 2016

(30) Foreign Application Priority Data

Jul. 16, 2014 (GB) ..... 1412635

(51) Int. Cl.
*B65D 51/24* (2006.01)
*B65D 85/804* (2006.01)
(Continued)

(52) U.S. Cl.
CPC ..... *B65D 51/245* (2013.01); *B26F 1/44* (2013.01); *B65D 43/02* (2013.01); *B65D 85/72* (2013.01);
(Continued)

(58) Field of Classification Search
CPC ..... B65D 51/245; B65D 43/02; B65D 43/00; B65D 43/0202; B65D 25/205;
(Continued)

(56) References Cited

U.S. PATENT DOCUMENTS 4,207,989 A 6/1980 Ingemann
4,215,797 A * 8/1980 Chen ..... B65D 43/022 220/276
(Continued)

FOREIGN PATENT DOCUMENTS

AT 12979 U1 3/2013
CA 2394952 6/2001
(Continued)

OTHER PUBLICATIONS

Communication of a Notice of Opposition dated Feb. 21, 2019, for European Application No. 15736036.3 (40 pages).
(Continued)

*Primary Examiner* — Robert Poon
(74) *Attorney, Agent, or Firm* — Fitch, Even, Tabin & Flannery LLP

(57) ABSTRACT

A die-cut lid for closing a container is formed from a flexible composite sheet material. The lid comprises a functional area bearing human-readable and/or machine-readable data. One or more rigidifying indentations are provided on the lid to promote flatness of the functional area in a resting state of the lid. The one or more rigidifying indentations can be in the form of one or more encircling indentations that border the functional area; and/or a planar indentation that encompasses the functional area.

26 Claims, 8 Drawing Sheets

(51) Int. Cl.
*B26F 1/44* (2006.01)
*B65D 43/02* (2006.01)
*B65D 85/72* (2006.01)

(52) U.S. Cl.
CPC .. *B65D 85/8058* (2020.05); *B26F 2001/4418* (2013.01); *B65D 2203/06* (2013.01)

(58) Field of Classification Search
CPC ..... B65D 77/2028; B65D 77/20245; B65D 77/2024; B65D 77/2032
USPC ..... 206/459.5; 220/270, 359.1, 359.2, 359.3
See application file for complete search history.

(56) References Cited

U.S. PATENT DOCUMENTS 4,557,414 A 12/1985 Ford
4,969,965 A 11/1990 Matty
4,977,772 A 12/1990 Bulso, Jr.
5,242,630 A 9/1993 Nuij
5,284,435 A 2/1994 Nuij
5,405,675 A 4/1995 Sawka
5,651,235 A 7/1997 Ashley
5,685,189 A 11/1997 Nguyen
5,722,319 A 3/1998 Hirano
5,840,189 A 11/1998 Sylvan
5,887,470 A 3/1999 Mirtsch
6,217,811 B1 4/2001 Mirtsch
6,440,530 B1 8/2002 Jud
6,540,497 B1 4/2003 Fuda
6,739,500 B1 5/2004 Gentile
6,761,848 B2 7/2004 Jud
6,981,177 B2 12/2005 Beattie
7,121,420 B2 10/2006 Baudin
7,140,812 B2 11/2006 Bryan
7,235,197 B2 6/2007 Brossman
7,510,675 B2 3/2009 Brossman
7,832,188 B2 11/2010 ONeill
8,012,521 B2 9/2011 Garwood
8,220,704 B2 7/2012 Atkin
8,282,382 B2 10/2012 Mazzarolo
8,322,177 B2 12/2012 Meier
8,459,087 B2 6/2013 Konig
8,535,743 B2 9/2013 Kamerbeek
8,613,879 B2 12/2013 Atkin
2003/0185947 A1 10/2003 Garwood
2003/0235660 A1 12/2003 Blanchard
2004/0010998 A1 1/2004 Turco
2004/0012109 A1 1/2004 Brossman
2004/0058129 A1 3/2004 Bouic
2004/0146602 A1 7/2004 Garwood
2004/0185152 A1 9/2004 Garwood
2004/0185154 A1 9/2004 Garwood
2004/0185155 A1 9/2004 Garwood
2004/0185156 A1 9/2004 Garwood
2004/0262255 A1 12/2004 Murgia
2005/0035011 A1* 2/2005 McRobbie ..... B65D 51/245 206/217
2005/0123724 A1 6/2005 Blanchard
2005/0151300 A1 7/2005 Harper
2005/0209076 A1 9/2005 Boutron
2005/0247713 A1* 11/2005 Niederer ..... B65D 77/2032 220/359.2
2007/0039433 A1 2/2007 Bryan
2007/0062396 A1 3/2007 Takai
2007/0241473 A1 10/2007 Brossman
2008/0057312 A1 3/2008 Walter
2008/0072536 A1 3/2008 Chesters
2008/0118720 A1 5/2008 Thomas
2009/0041626 A1 2/2009 Atkin
2009/0109518 A1 4/2009 Atkin
2009/0134547 A1 5/2009 Bauer
2009/0165876 A1 7/2009 Atkin
2009/0166562 A1 7/2009 Atkin
2010/0001014 A1 1/2010 Tabone
2010/0078480 A1* 4/2010 Aker ..... G06K 19/06009 235/462.08
2010/0116775 A1 5/2010 Dede
2010/0200449 A1* 8/2010 Kasboske ..... G09B 21/003 206/459.5
2010/0213193 A1 8/2010 Helmlinger
2010/0287893 A1 11/2010 Ehrmann
2011/0024310 A1 2/2011 ONeill
2011/0028293 A1 2/2011 Atkin
2012/0045554 A1* 2/2012 Carvin ..... B65D 79/005 426/106
2012/0064293 A1 3/2012 Siemen
2012/0225171 A1 9/2012 Garwood
2012/0305584 A1* 12/2012 Carson ..... A61J 1/03 221/1
2013/0062364 A1* 3/2013 Carlson ..... G09F 7/00 222/23
2013/0071589 A1 3/2013 Hannington
2013/0139190 A1 5/2013 Ohishi
2013/0202826 A1 8/2013 Romeiro
2013/0333575 A1 12/2013 Kamerbeek
2015/0041470 A1* 2/2015 Huffer ..... B65D 77/2056 220/270

FOREIGN PATENT DOCUMENTS

CH 673827 4/1990
CN 1942125 A 4/2007
CN 201287895 8/2009
CN 201287895 Y 8/2009
DE 4437986 4/1996
DE 19512533 10/1996
DE 19634244 2/1998
DE 19750576 6/1999
DE 19800038 7/1999
DE 19840981 11/1999
DE 10100853 7/2002
DE 10338954 3/2005
DE 202005006038 6/2005
DE 102008030934 1/2009
DE 102008008442 8/2009
EP 0242252 11/1989
EP 0479765 4/1992
EP 0535998 4/1993
EP 0610762 8/1994
EP 0630737 12/1994
EP 0683110 11/1995
EP 0742148 11/1996
EP 0798108 10/1997
EP 0881162 12/1998
EP 0914935 5/1999
EP 0936004 8/1999
EP 1340694 9/2003
EP 1358993 11/2003
EP 1480077 11/2004
EP 1790470 5/2007
EP 1935805 6/2008
EP 2345352 7/2011
EP 2345352 A1 7/2011
EP 2522593 11/2012
EP 2639063 9/2013
EP 2698745 2/2014
EP 2698745 A1 2/2014
FR 2724630 3/1996
FR 2731986 9/1996
FR 2753996 4/1998
FR 2753997 4/1998
FR 2898345 9/2007
GB 2385046 8/2003
GB 2411105 8/2005
JP S598592 U 1/1984
JP H078228 U 2/1995
JP H09221171 8/1997
JP 2000255619 9/2000
JP 2003128104 A 5/2003
JP 2008207822 9/2008
JP 5364388 8/2010
WO 9601180 1/1996

(56) References Cited

FOREIGN PATENT DOCUMENTS

| | | |
|---|---|---|
| WO | 9632341 | 10/1996 |
| WO | 9749510 | 12/1997 |
| WO | 9929508 | 6/1999 |
| WO | 0172446 | 10/2001 |
| WO | 03057566 | 1/2003 |
| WO | 2004056672 | 1/2004 |
| WO | 2004062887 | 1/2004 |
| WO | 2005079638 | 9/2005 |
| WO | 2006011576 | 1/2006 |
| WO | 2006042940 | 1/2006 |
| WO | 2006096894 | 1/2006 |
| WO | 2010026421 | 1/2010 |
| WO | 2011048341 | 1/2011 |
| WO | 2012048693 | 1/2012 |
| WO | 2013004417 | 1/2013 |
| WO | 2013072351 | 1/2013 |
| WO | 2014024958 | 1/2014 |
| WO | 2015020727 | 2/2015 |
| WO | 2016009258 | 1/2016 |

OTHER PUBLICATIONS

Communication of a Letter from the Proprietor of the Patent dated Jul. 15, 2019, for European Application No. 15736036.3 (101 pages).
Chinese Intellectual Property Office, English Translation of Combined Search and Examination Report dated Nov. 3, 2017 for Chinese Patent Application No. 201580043252.5 (16 pgs.).
Combined Search and Examination Report dated Jan. 14, 2015 for Application No. GB1412635.3 (7 pgs.).
International Search Report, dated Aug. 31, 2015 for International Application No. PCT/IB2015/001068 (2 pgs.).
Written Opinion of the International Searching Authority for PCT/IB2015/001068 (4 pgs.).
Canadian Intellectual Property Office Requisition by the Examiner, dated Sep. 30, 2016 for Canadian Patent Application No. 2,894,434 (4 pgs.).
Submission in Opposition Proceedings filed against European Patent No. EP3169611 dated Oct. 12, 2021 for European Application No. 15736036.3 (8 pgs.).
Examination Report dated Oct. 31, 2019, for Indian Application No. 201747001414 (6 pgs.).
Notification of Reason for Refusal dated Dec. 19, 2017, for Korean Application No. 2017-7001099, with English translation (17 pages).
Brief communication—Opposition Proceedings dated Nov. 26, 2020; European Application No. 15736036.3 (13 pgs.).
Further Submission in Opposition Proceedings filed against European Patent No. EP3169611 dated Dec. 10, 2019 for European Application No. 15736036.3 (58 pgs.).
GS1 US, "Guidelines for Bar Code Symbol Placement" GS1 US, 2007 (96 pgs.).
Preliminary and non-binding opinion of the Opposition Division, Information concerning oral proceedings dated Mar. 25, 2020; European Application No. 15736036.3 (10 pgs.).
Rajput, R.K., "A Textbook of Manufacturing Technology: Manufacturing Processes" Laxmi Publications (P) LTD, 2007, p. 184.
Summons to attend oral proceedings pursuant to Rule 115(1) EPC dated Dec. 21, 2020; European Application No. 15736036.3 (20 pgs.).
Supplementary Comments in the Oppostion to European Patent No. EP3169611 dated Oct. 7, 2019; European Application No. 15736036.3 (30 pgs.).
Written Submission in Opposition Proceedings filed against European Patent No. EP3169611 dated Nov. 23, 2020 for European Application No. 15736036.3 (12 pgs.).
Results of Oral Proceedings of Dec. 8, 2020, dated Dec. 14, 2021; European Patent Application No. 15736036.3 (5 pgs.).

* cited by examiner

DIE-CUT LID AND ASSOCIATED CONTAINER AND METHOD

CROSS-REFERENCE TO RELATED APPLICATION

This application claims the benefit of Great Britain Application No. 1412635.3, filed Jul. 16, 2014, and which is hereby incorporated by reference in its entirety.

FIELD

The present disclosure relates to die-cut lid, a lidded container comprising such a die-cut lid and a method of forming a die-cut lid.

BACKGROUND

It is known to form lidded containers such as beverage capsules or containers, yogurt pots, pudding cups, beverage cups, gum or candy containers and food tubs from a container having a body with an open mouth and a lid which is sealed to the body so as to close the open mouth of the container. It is also known to form the lid by cutting a suitably-shaped piece of flexible material from a sheet, which may be formed from a single material or may be a composite sheet of material containing two or more layers. The lid may be die-cut from the sheet material. It is known for such lids to comprise a functional area bearing data intended to be read. For example, lids may be provided with a printed barcode that is to be machine-read, for instance at a point-of-sale.

On a typical packaging line, lids which have previously been cut from the sheet material may be held in a stack of lids in a lid magazine ready to be sealed to containers once the containers have been filled with the required contents. Each lid may be removed from the stack of lids and conveyed into engagement with a container by means of a suitable device, for example a vacuum cup device which is intended to pick off the leading lid from the stack of lids, remove it from the magazine and transfer the lid to the location of the container requiring sealing. After sealing, the lidded containers may be placed in further packaging and transported for onward use.

A problem that may occur with such die-cut lids during assembly and/or storage is that the functional area does not remain sufficiently flat for accurate and consistent reading of the data therefrom. This may particularly be the case where the data is machine-read by means of a non-contact sensor, for example a barcode reader, since no physical contact between the functional area and the non-contact sensor takes place which might assist in flattening the functional area. It has also been found that this is a particular problem where the lids are formed from a composite sheet material, since the differing materials in the different layers of the composite sheet material can lead to curling of the relatively thin lids and the functional area, for example due to different coefficients of thermal expansion of the materials.

Lack of flatness of the functional area can lead to unacceptable levels of misreads where the data is to be machine-read and can make the data more difficult to discern where the data is to be human-read.

SUMMARY OF THE DISCLOSURE

In a first aspect the present disclosure provides a die-cut lid for closing a container, the lid being formed from a flexible composite sheet material;

the lid comprising a functional area bearing human-readable and/or machine-readable data;

the lid comprising one or more rigidifying indentations to promote flatness of the functional area in a resting state of the lid;

wherein the one or more rigidifying indentations are selected from the group of:

i. one or more encircling indentations that border the functional area; and/or ii. a planar indentation that encompasses the functional area.

Advantageously, providing the lid with one or more rigidifying indentations that encircle and border the functional area and/or are planar indentations that encompass the functional area helps to stiffen the lid in at least the region of the functional area and helps to maintain the flatness of the functional area by reducing any curl of the lid. By preferably restricting the one or more rigidifying indentations to only the functional area and/or the area bordering the functional area the function of the remainder of the lid is unaffected. For example, the process of sealing the lid to a body of the container is unchanged.

The lid may comprise more than one functional area. For example, the lid may have a barcode panel and a date code panel; the lid may have a barcode panel and a best before panel; or the lid may have a first barcode panel and a second barcode panel. The lid may, in some examples have first, second and third barcode panels.

The data in the functional area may be written in any convenient manner. For example, the data may typically be printed onto a surface of the composite sheet material. Alternatively, the data may be etched, laser-marked, etc. in the functional area.

The functional area may bear one or more of a barcode, a date code or a best before indication.

The one or more rigidifying indentations may comprise a continuous encircling indentation that fully encircles the functional area. Alternatively, the one or more rigidifying indentations may comprise one or more discontinuous encircling indentations that partially or fully encircles the functional area.

In one example the one or more rigidifying indentations comprise a plurality of encircling indentations with at least a first encircling indentation bordering the functional area and a second encircling indentation located concentric to the first encircling indentation.

The planar indentation may comprises a flat, planar portion that is indented in relief relative to a remainder of the lid outside the functional area. Preferably the planar portion is raised relative to a remainder of the lid.

The functional area may comprise less than 70%, preferably less than 50%, more preferably less than 30%, more preferably less than 20% of the lid.

The lid may have a nominal dimension, being the largest dimension of the lid, and the height of the one or more rigidifying indentations measured perpendicular to the plane of the lid may be up to 3% of the nominal dimension.

The lid may have a size from 30 mm upwards.

In one example the one or more rigidifying indentations have a height measured perpendicular to the plane of the lid of from 400 to 3000 microns, preferably from 600 to 1000 microns, more preferably 700 microns.

The flexible composite sheet material prior to forming the lid may have a thickness of from 40 to 100 microns.

The composite sheet material may be embossed over at least a major portion of the lid so as to have an embossed thickness of up to 200 microns.

The one or more rigidifying indentations are preferably formed to protrude convexly from an outer face of the lid, wherein the outer face of the lid is defined as the face of the lid facing away from an interior of a container after lidding.

The one or more encircling indentations may have a U- or V-shaped cross-sectional form.

The lid may have a nominal dimension, being the largest dimension of the lid, and the width of the one or more encircling indentations may be up to 5% of the nominal dimension. In one example, the width of the one or more encircling indentations is from 400 to 5000 microns, preferably from 1500 to 2500 microns.

The flexible composite sheet material may comprise an aluminium layer and/or a metallised layer. The flexible composite sheet material may comprise one or more polymer layers. The one or more polymer layers may be selected from the group of a polypropylene (PP) layer and a polyethylene terephthalate (PET) layer. In one example, the flexible composite sheet material comprises a polypropylene layer, an aluminium layer and a polyethylene terephthalate (PET) layer.

In a second aspect the present disclosure provides a lidded container comprising a body having an open mouth and a lid which is sealed to the body so as to close the open mouth of the body to define an interior of the lidded container, wherein the lid is a die-cut lid as described above.

The functional area may be located above the open mouth of the body. Advantageously, the presence of the one or more rigidifying indentations allows the flatness of the functional area to be better maintained even where the functional area is unsupported—i.e. relatively distant from a supporting part of the body.

The container may be a beverage capsule or container, a yogurt pot, a pudding cup, a beverage cup, a gum or candy container, a food tub, or other similar consumer-related food/non-food container.

In a third aspect the present disclosure provides a method of forming a die-cut lid, comprising the steps of:

a) providing a flexible composite sheet material;

b) printing human-readable and/or machine-readable data on the flexible composite sheet material;

c) forming one or more rigidifying indentations to promote flatness of a functional area encompassing said human-readable and/or machine-readable data, wherein the one or more rigidifying indentations are selected from the group of:

i. one or more encircling indentations that border the functional area; and/or ii. a planar indentation that encompasses the functional area; and die-cutting the flexible composite sheet material to form the lid.

At least a portion of the lid may be additionally embossed, preferably prior to step c).

The one or more rigidifying indentations may be formed by stamping/pressing or rolling.

BRIEF DESCRIPTION OF THE DRAWINGS

Embodiments of the present disclosure will now be described, by way of example only, with reference to the accompanying drawings, in which.

DETAILED DESCRIPTION

Figure 1:
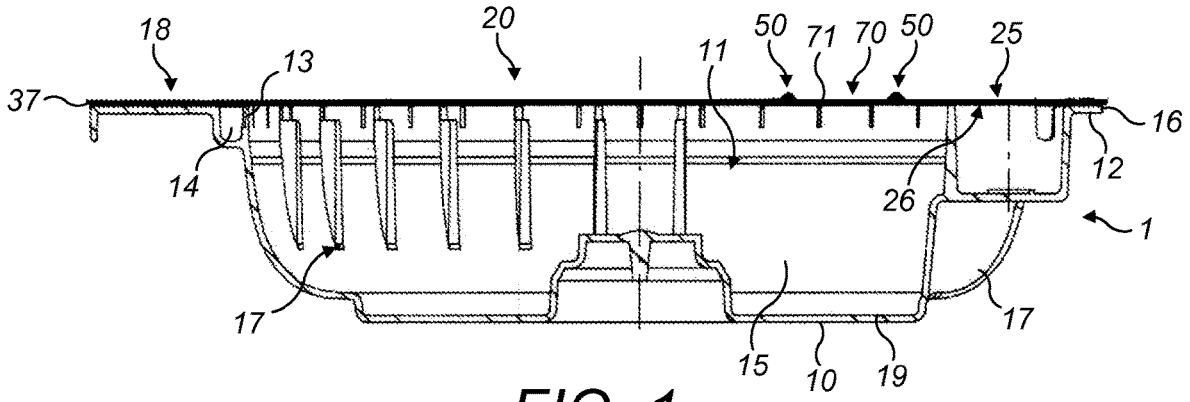
FIG. 1 is a cross-sectional view of a lidded container according to the present disclosure, comprising a body and a lid.

In the following description, the disclosure will be illustrated by way of example with reference to a lid and container for forming a lidded container in the form of a beverage cartridge (otherwise known as a beverage capsule), in particular, a beverage cartridge that is a sealed, machine-insertable cartridge that can be used with a beverage preparation system for dispensing one of a range of beverage types on demand, preferably in a domestic setting. However, it will be understood that the lids, containers and methods of the present disclosure may be used to form other types of lidded container, for example yogurt pots, pudding cups, beverage cups, gum containers, candy containers and food tubs of the type used for holding products such as margarine, fat-based spreads, cheese spreads, containers for other non-food consumer applications, etc.

In the following description, the lid is described as having a "nominal dimension". The nominal dimension is defined as the longest dimension of the lid being any of the diameter, length or width of the lid. For example, for a circular lid the nominal dimension would be equal to the diameter of the lid. In the case of a square lid, the nominal dimension would be equal to the width of the lid. In the case of a rectangular lid, the nominal dimension of the lid would be the longest of the width or length of the lid.

FIGS. 1 to 5 show a first example of a container 1 and a lid 20 for forming a lidded container.

The container 1 comprises a body 10 which may be cup-shaped so as to define an interior 15 of the container. The body 10 defines an open mouth 11 which is surrounded by a rim 16 and a flange 12 which extends radially outwards from the rim 16. In the illustrated example, the body 10 may further define an annular void space 14 between an interior wall 13 of the container and the flange 12. In this case, a free edge of the interior wall 13 may define the rim 16. In an alternative, non-illustrated, example there may be no interior wall 13 and the flange 12 may extend directly from the rim 16.

Figure 2:
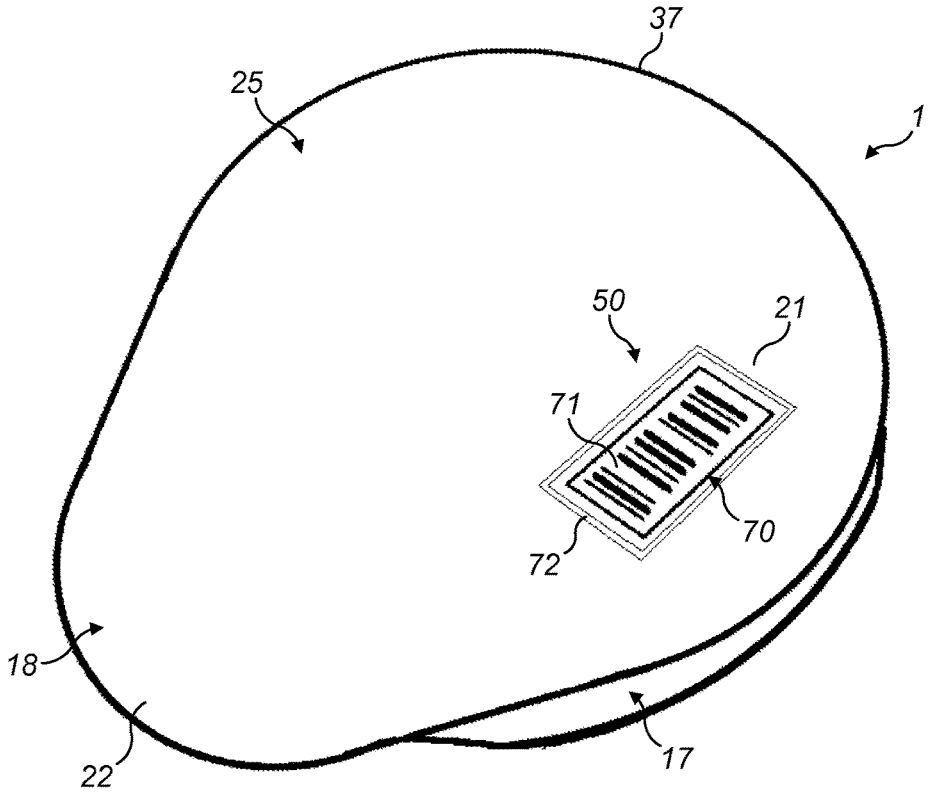
FIG. 2 is a perspective view of the lidded container of FIG. 1.

The container 1 may be generally circular in shape and in particular may comprise a generally disc-shaped section 17 as shown in FIG. 2. A lobe section 18, also shown in FIG. 2, may extend from the disc-shaped section 17 at one point to form a handle of the container 1 which provides a means for grasping the lidded container in use. As shown in FIG. 1, where present, the lobe section 18 of the body 10 may be formed from enlarged part of the flange 12.

The container 1 may comprise an additional inner member if desired which extends from a base 19 of the body 10 towards the open mouth 11.

The body 10 of the container 1 may be formed from a variety of materials and using a variety of processes. The material may be, for example, high density polyethylene, polypropylene, polystyrene, polyester, or a laminate of two or more of these materials. The material may be opaque, transparent or translucent. The body 10 may be formed by, for example, injection moulding or thermoforming. The body 10 may be formed as a single unitary piece or from a plurality of pieces which are assembled together. Where an additional inner member is provided in the container 1 this may be formed unitarily with a remainder of the body 10 or may be joined to the remainder of the body 10, for example by adhesive or ultrasonic welding.

The lid 20 may be a generally thin, planar element formed from a sheet material 30. The lid 20 may be die-cut from the sheet material 30. The lid 20 is bounded by a peripheral edge 37.

The lid 20, as shown in FIGS. 1 and 2, is preferably sized and shaped to match the size and shape of the flange 12 of the container 1 (including the size and shape of any lobe section 18 of the flange 12 which may be present). Thus, once the lid 20 is lidded onto the container 1, the peripheral edge 37 of the lid 20 will preferably align with a peripheral edge of the flange 12 of the body 10 without the lid 20 overhanging the flange 12 nor leaving any part of the flange 12 uncovered.

In an alternative arrangement, for example where the lid 20 may be intended to be peelable, in use, off the body 10, a section of the lid 20 may overhang the flange 12 of the body 10 and function as a finger-grip location to facilitate peeling of the lid 20 from the container 1.

In the illustrated example of FIG. 2 the lid 20 comprises a circular region 21 having a lobe region 22 extending therefrom which are respectively sized and shaped to match the size and shape of the disc-shaped section 17 and lobe section 18 of the body 10. In the present example the diameter of the circular region 21 is 68 mm. The nominal dimension 36 as shown in FIG. 2 of the lid 20 will be the longest dimension extending across both the circular region 21 and the lobe region 22. However, of course it will be understood that the present disclosure can be applied to lids of a wide range of sizes. For example, the lid may have a size from 30 mm upwards.

An outer face 25 of the lid is defined as the face of the lid 20 intended in use to face away from the interior 15 of the container 1 after lidding. Conversely, the inner face 26 of the lid 20 is defined as the face of the lid 20 intended in use to face into the interior 15 of the container 1 after lidding.

The sheet material 30 is preferably formed from a flexible composite sheet material having two or more layers. The layers of the composite sheet material 30 may be permanently or semi-permanently attached together. The composite sheet material 30 may be formed by a suitable process such as co-extrusion or lamination.

The composite sheet material 30 may comprise an aluminium layer and/or a metallised layer. The composite sheet material 30 may comprise a paper-containing layer. The composite sheet material 30 may comprise one or more polymer layers, for example a polypropylene layer and/or a polyethylene terephthalate (PET) layer.

The sheet material may have an initial thickness $t_1$ from 40 to 100 microns.

Figure 18:
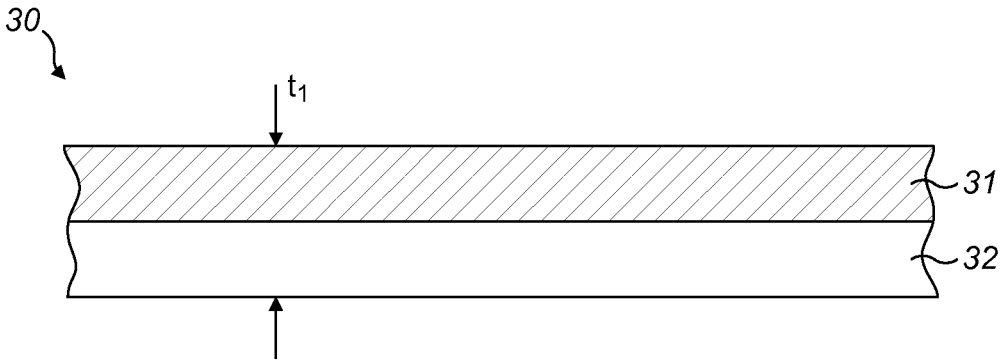
FIG. 18 is a schematic cross-sectional view of a composite sheet material.

One example of a suitable composite sheet material 30 is shown in FIG. 18 which comprises an aluminium layer 31 and a polypropylene layer 32. The polypropylene layer 32 may form a heat seal layer of the lid 20. The aluminium layer 31 may have a thickness of from 36 to 40 microns, preferably 38 microns. The polypropylene layer 32 may have a thickness of from 25 to 30 microns, preferably 27 microns. This example of composite sheet material 30 may be particularly suitable where the lidded container will contain dry contents.

Figure 19:
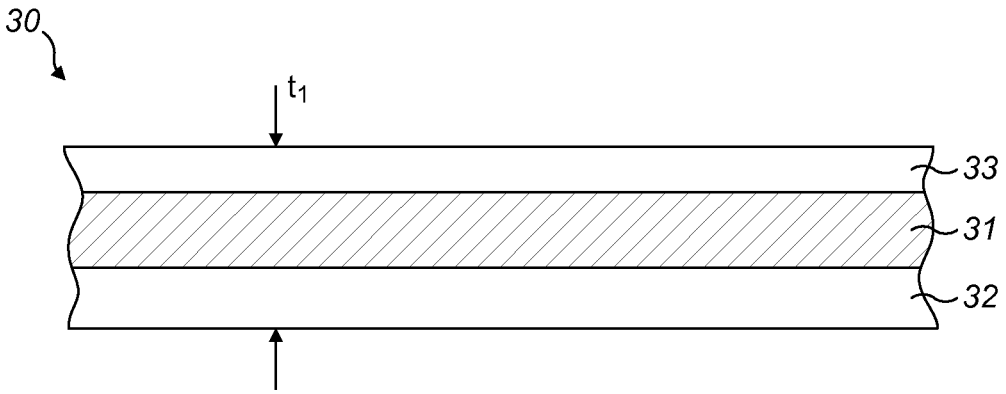
FIG. 19 is a schematic cross-sectional view of another composite sheet material.

Another suitable composite sheet material 30 is illustrated in FIG. 19 wherein the flexible composite sheet material 30 comprises a PET layer 33 then an aluminium layer 31 and finally a polypropylene layer 32. Again, the polypropylene layer 32 may form a heat seal layer of the lid 20. The aluminium layer 31 may have a thickness of from 36 to 40 microns, preferably 38 microns. The polypropylene layer 32 may have a thickness of from 25 to 30 microns, preferably 27 microns. The PET layer 33 may have a thickness of 11 to 13 microns, preferably 12 microns. This example of composite sheet material 30 may be particularly suitable where the lidded container will contain wet contents.

In both examples, preferably the heat seal layer formed by the polypropylene layer 32 defines the inner face 26 of the lid 20.

In both examples, the composite sheet material 30 may further comprise one or more primer layers, one or more lacquer layers, one or more adhesive layers and printing as desired.

The lid 20 may be subjected (before or after being cut from the sheet material 30) to a general embossing treatment in order to enhance the stiffness of the sheet material 30 to a certain degree. The embossing may be carried out by mechanical means such as passing the sheet material between counteracting rollers.

The embossing of the sheet material 30 may extend across the full area of the lid 20. Alternatively, one or more portions of the lid 20 may not be embossed.

Figure 3:
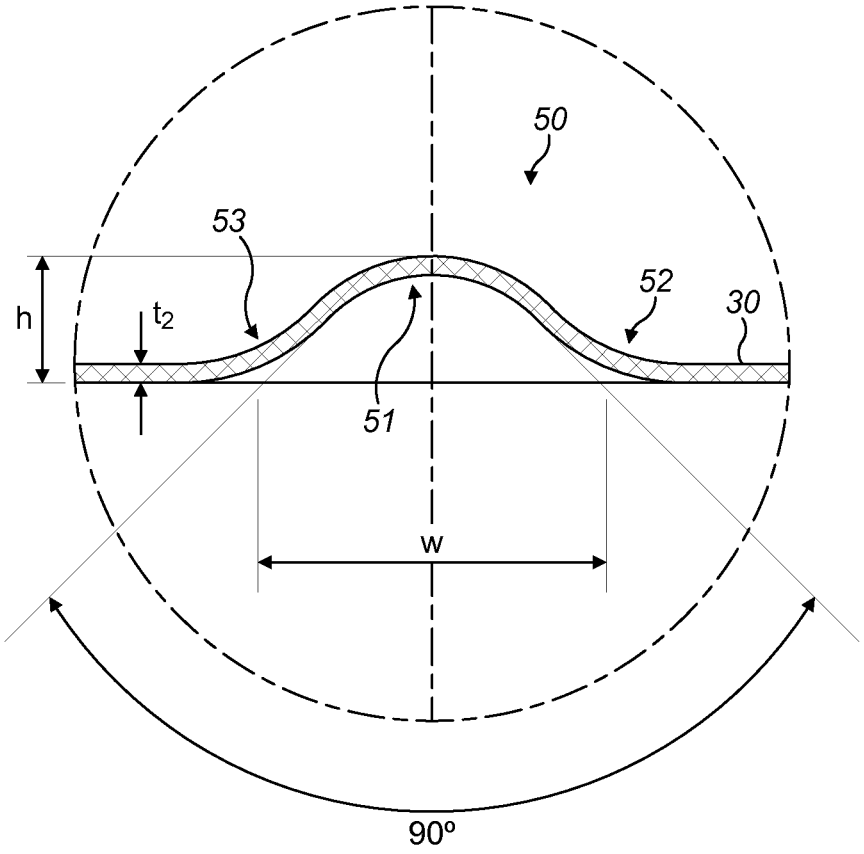
FIG. 3 is a cross-sectional view through a portion of the lid of FIG. 1.
Figure 4:
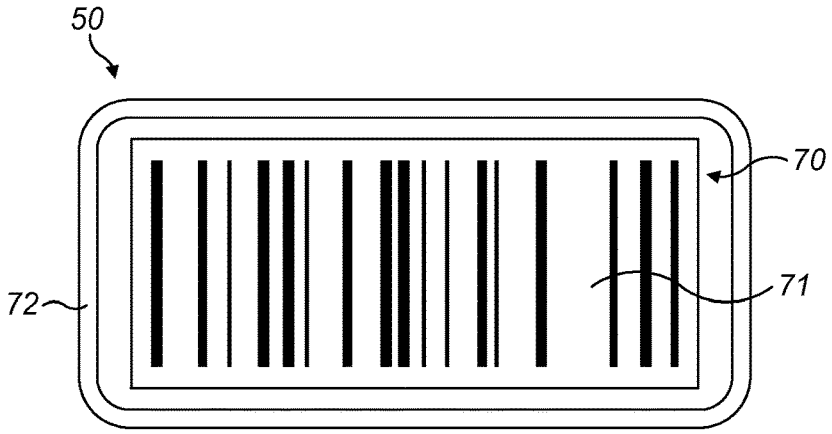
FIG. 4 is a schematic view of a functional area of the lid of FIG. 1.

The embossing treatment may increase the initial thickness $t_1$ of the sheet material 30 by up to four times compared to the thickness $t_1$ of the original sheet material 30, such that the lid 20 has a general thickness $t_2$ as shown in FIG. 3. Preferably the thickness $t_2$ of the embossed sheet material 30 is less than 200 microns.

As shown in FIG. 1, the lid 20 comprises one or more functional areas 70. Each functional area 70 contains data that may be machine-readable and/or human-readable. In the illustrated example of FIG. 1, one functional area 70 is provided in the form a barcode 71 that is printed on the outer face 25 of the lid (although the printed barcode 71 may be covered by a clear lacquer coating).

Figure 5:
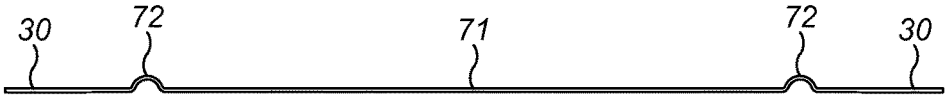
FIG. 5 is a schematic cross-sectional view of the functional area of FIG. 4.

As well as, or instead of, the general embossing of the lid 20, the lid 20 is also provided with one or more rigidifying indentations 50 to help maintain flatness of the functional area 70. In the example of FIGS. 1 to 5, the rigidifying indentation 50 comprises a single encircling indentation 72 that borders the functional area 70. The encircling indentation is continuous around the border of the functional area 70. As shown in FIG. 5, the portion of the lid 20 within the functional area 70 bearing the barcode 71 is at the same level as a remainder of the lid outside the encircling indentation 72.

The one or more rigidifying indentations 50, as shown in FIG. 3, may have a U-shaped cross-sectional form. The U-shape may be relatively 'soft' such that the apexes 51, 52 and 53 of the rigidifying indentation 50 are radiused so as to prevent sharp angular deviations in curvature of the sheet material 30 which could undesirably weaken the sheet material 30 or damage any barrier layer of the composite sheet material 30. For example, in the illustration at FIG. 3, a width w of the rigidifying indentation 50 may be 1900 microns and the radius of curvature of the apexes 51, 52 and 53 may each be 800 microns.

In an alternative example the rigidifying indentation 50 may have a V-shaped cross-sectional form, wherein the radius of curvature of the apex at the base of the 'V' (equivalent to apex 51 in FIG. 3) is less than the radius of curvature of the outer apexes 52 and 53.

In the illustrated example of FIG. 3, the rigidifying indentation 50 protrudes convexly from the outer face 25 of the lid 20. Alternatively the rigidifying indentation 50 can be configured to protrude convexly from the inner face 26 of the lid 20.

The rigidifying indentation 50 may be formed by a stamping process (otherwise known as pressing) or for example rolling. Preferably the stamping process does not result in loss of material from the lid 20 in the region of the rigidifying indentation 50.

The stamping of the rigidifying indentation 50 may be carried out before or after the general embossing of the lid 20. The stamping of the rigidifying indentation 50 may be carried out before or after the cutting of the lid 20 from the sheet material 30. In one example process, a continuous web of the sheet material 30 is first generally embossed at a first station by being passed through counteracting rollers and then conveyed to a second station. At the second station the rigidifying indentation 50 is first formed at the required location in the sheet material 30 using a stamping tool. Finally the lid 20 is die-cut from the sheet material 30 using a die-cutting press. Preferably a plurality of rigidifying indentations 50 are formed in the sheet material 30 during each stroke of the stamping tool and likewise, preferably a plurality of lids 20 are die-cut from the sheet material on each stroke of the die-cutting press.

The height h of the rigidifying indentation 50, as shown in FIG. 3, is defined as the distance, in a direction perpendicular to the plane of the lid 20, between the outer face 25 of the sheet material 30 at the apex 51 of the rigidifying indentation 50 to the inner face 26 of the sheet material 30 in a region of the lid 20 that is un-indented as shown in FIG. 5.

The rigidifying indentation 50 may have a height h from 400 to 3000 microns, preferably 600 to 1000 microns. In the illustrated example of FIG. 3, the height h is 700 microns.

The width w of the rigidifying indentation 50, as shown in FIG. 3, is defined as the extent of the rigidifying indentation 50, in a direction perpendicular to the height h of the rigidifying indentation 50.

The rigidifying indentation 50 may have a width w up to 5% of the nominal dimension 36 of the lid 20. In one example the width w is from 400 to 5000 microns, preferably from 1500 to 2500 microns. In the illustrated example of FIG. 3, the width w is 1900 microns.

The encircling indentation 72 helps to maintain the flatness of the barcode 71 by stiffening the lid 20 in the region of the functional area 70.

The formed lids 20 may be stored and/or transferred in a stack of similar lids 20. The lids 2 may be held in a magazine. The one or more rigidifying indentations 50 may also act as a nesting feature to promote better stacking of the lids 20.

The lidding process involves the steps of transferring the lid 20 into engagement with the container 1 and sealing the lid 20 to the container 1 so as to close the open mouth 11. The conveyancing may be by means of a vacuum cup device.

In the example of FIG. 1, the lid 20 is sealed to the flange 12 of the container 1 including the lobe section 18.

The functional area 70 and the one or more rigidifying indentations 50 may be located on the lid 20, and the lid 20 may be engaged with the container 1 such that the functional area 70 and the one or more rigidifying indentations 50 are located above the open mouth 11 of the container 1.

The lid 20 may be sealed to the container 1 by a heat-seal tool. The heat-seal tool may act to both press the lid 20 into engagement with the flange 12 and heat the heat-seal layer of the composite sheet material 30 sufficiently to create the required bond between the composite sheet material 30 and the flange 12 of the container 1.

Figure 6:
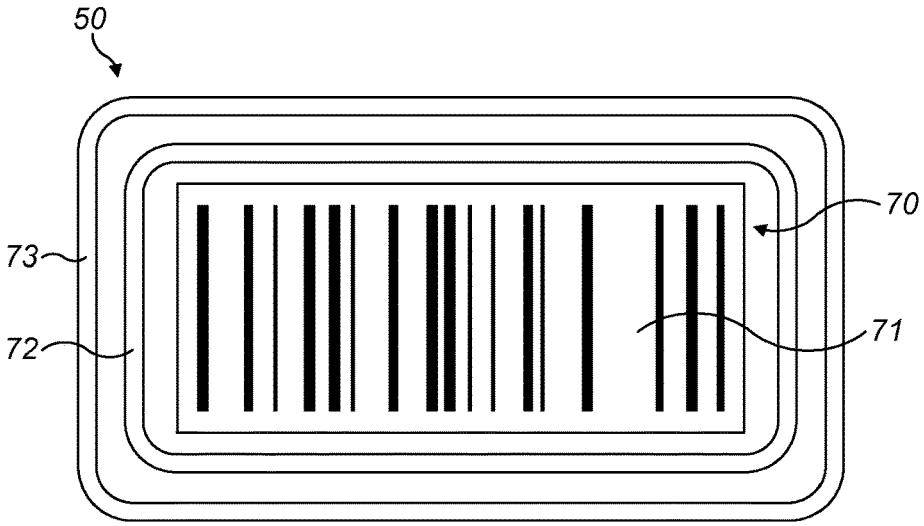
FIG. 6 is a schematic view of a functional area of another lid of the present disclosure.
Figure 7:
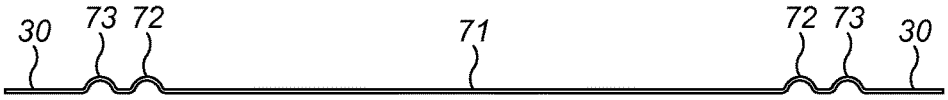
FIG. 7 is a schematic cross-sectional view of the functional area of FIG. 6.

FIGS. 6 and 7 illustrate a further example of the one or more rigidifying indentations 50 that can be used to support the functional area 70. In this example two encircling indentations 72, 73 are provided which are concentric to each other—a first encircling indentation 72 that borders the functional area 70 and a second encircling indentation 73 which lies outwardly of the first encircling indentation 72. Each encircling indentation 72, 73 may be of the type as described in the above example of FIGS. 1 to 5. The use of two (or more) encircling indentations may provide greater stiffness to the functional area 70.

Figure 8:
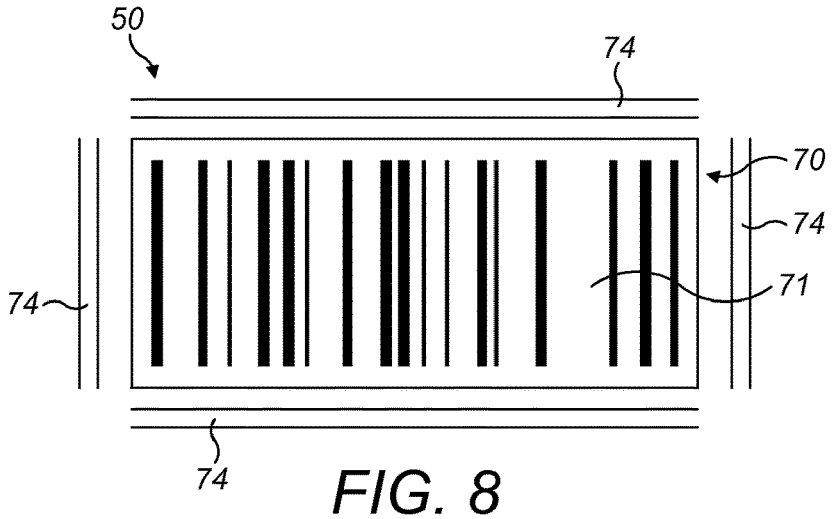
FIG. 8 is a schematic view of a functional area of another lid of the present disclosure.
Figure 9:
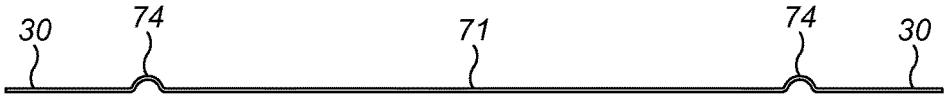
FIG. 9 is a schematic cross-sectional view of the functional area of FIG. 8.

FIGS. 8 and 9 illustrate a further example of the one or more rigidifying indentations 50 that can be used to support the functional area 70. In this example a discontinuous encircling indentation 74 is provided that borders the functional area 70. As shown the discontinuous encircling indentation 74 may comprise one or more gaps in its path where the lid 20 is not indented. In other respects the rigidifying indentation 50 may be of the type as described in the above example of FIGS. 1 to 5.

Figure 10:
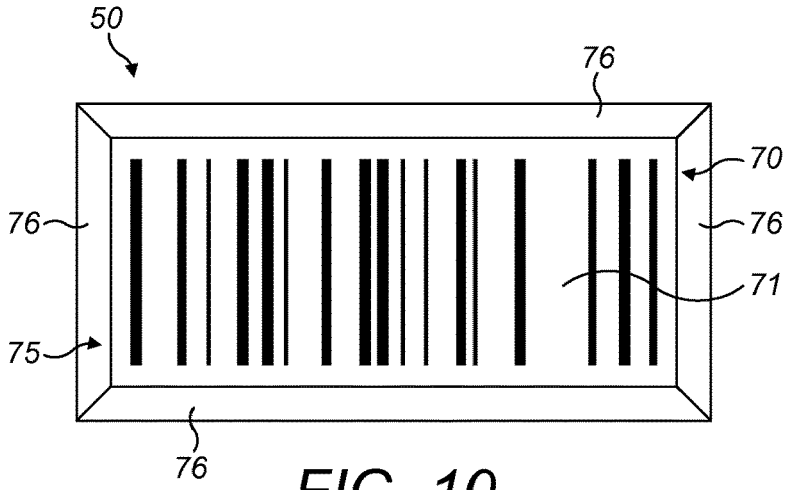
FIG. 10 is a schematic view of a functional area of another lid of the present disclosure.
Figure 11:
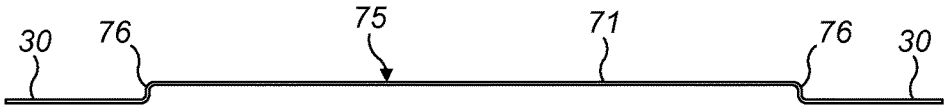
FIG. 11 is a schematic cross-sectional view of the functional area of FIG. 10.

FIGS. 10 and 11 illustrate a further example of the one or more rigidifying indentations 50 that can be used to support the functional area 70. In this example a planar indentation 75 is provided that encompasses the functional area 70. As shown the entire functional area 70 is indented relative to a remainder of the lid 20 so that it is formed in relief. Each side of a border 76 of the functional area 70 is deformed so as to raise the level of the functional area 70 above the remainder of the lid 20. As with the above examples, the planar indentation 75 may be formed by stamping/pressing or rolling of the lid 20. The height h of the planar indentation 75 may, as above, be from 400 to 3000 microns, preferably 600 to 1000 microns. The geometry of the roof-like arched structure of the planar indentation 75 acts to stiffen the lid 20 in the region of the functional area 70 helping to maintain its flatness.

Figure 12:
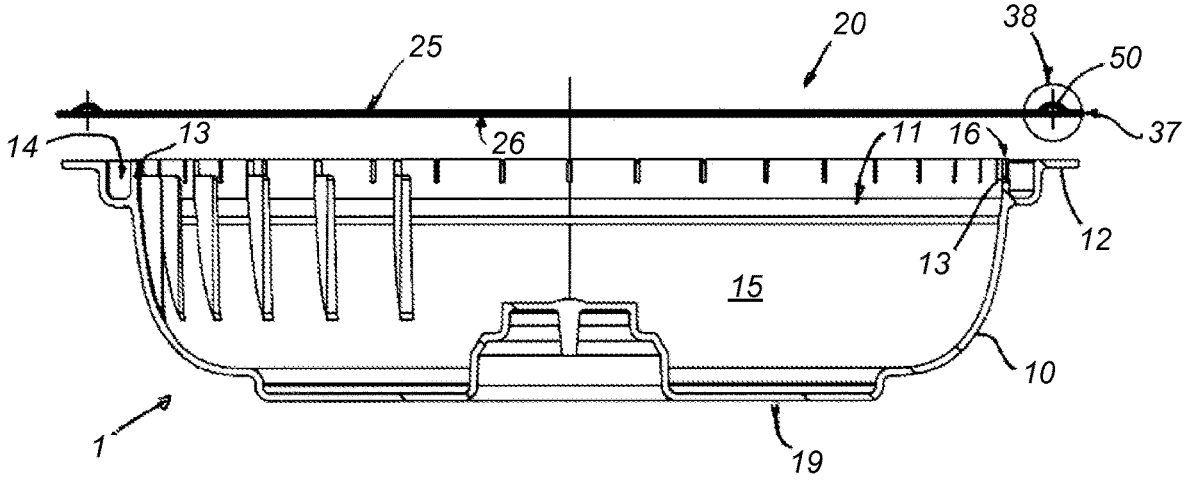
FIG. 12 is a cross-sectional view of a body and a lid prior to sealing.
Figure 13:
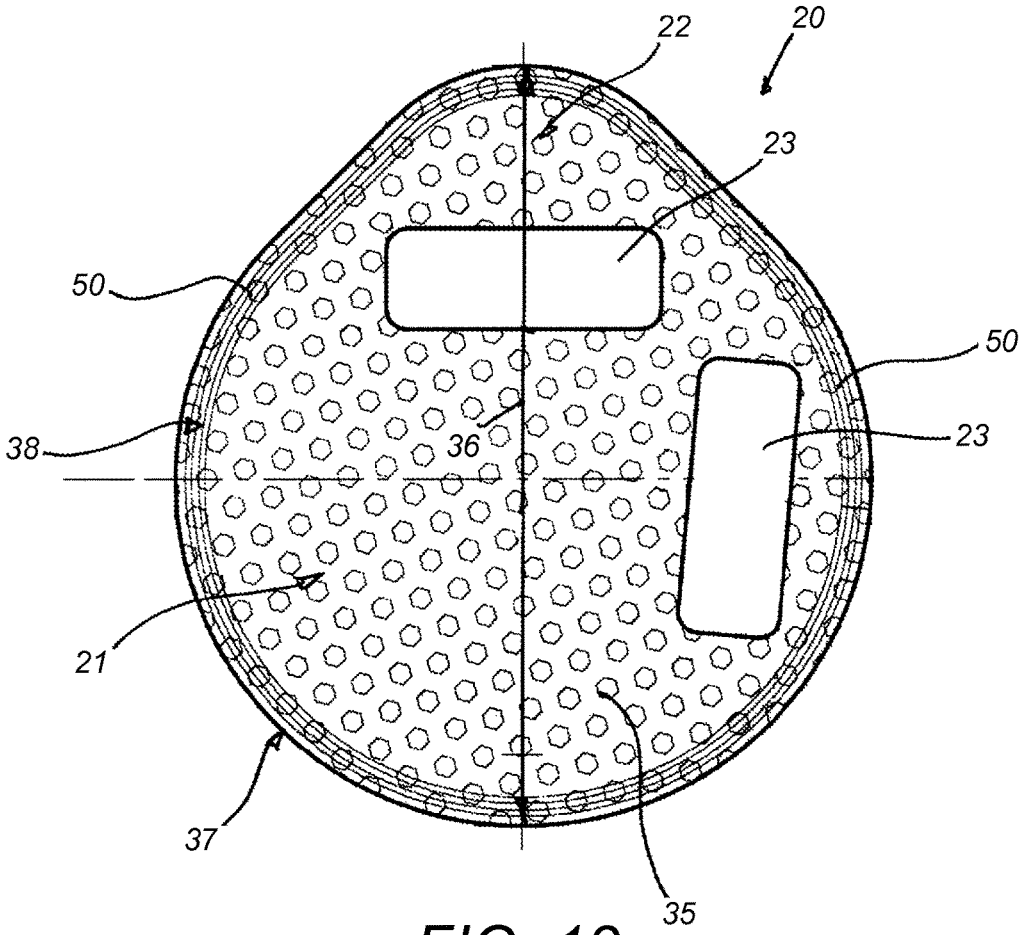
FIG. 13 is a plan view of the lid of FIG. 12.
Figure 14:
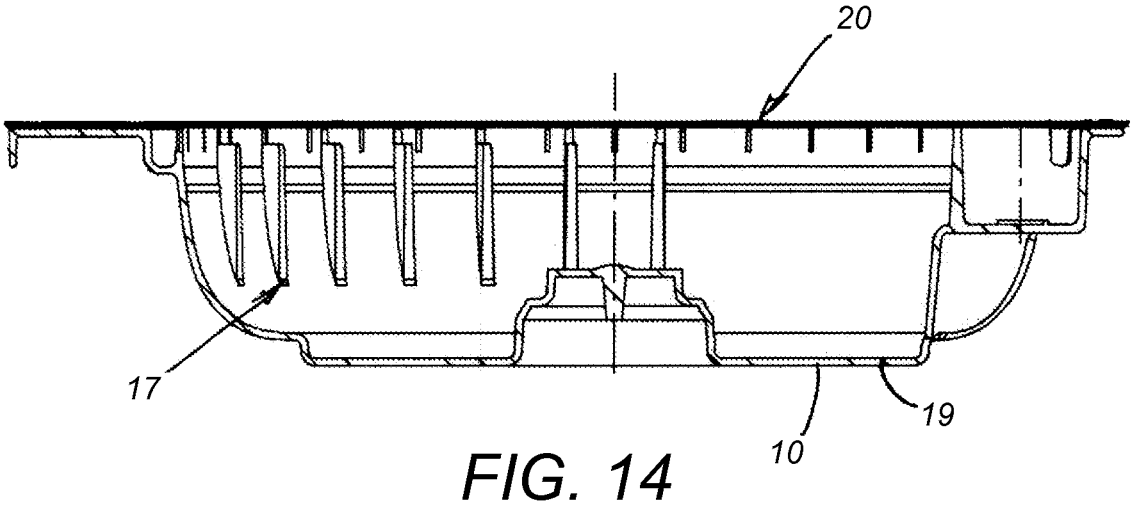
FIG. 14 is a cross-sectional view of the container and lid of FIG. 12 after sealing.

FIGS. 12 to 14 show another example of lid 20 for forming a lidded container that comprises a rigidifying indentation 50 which can be used with a container 1 of the type described above.

The basic form of the lid 20, in terms of its overall size, materials, composition, and optional general embossing are as described in the above examples. However, in the following examples the rigidifying indentation 50 is located, not bordering the functional area of the lid 20, but rather in a peripheral region 38 of the lid 20.

The peripheral region 38 of the lid 20 is defined as that part of the lid 20 which is no more than 10% of the nominal dimension 36 of the lid 20 away from the peripheral edge 37 of the lid 20. In the illustrated example the rigidifying indentation follows the shape of the peripheral edge 37 in that the distance from the peripheral edge 37 to the rigidifying indentation 50 is constant around the full path length of the rigidifying indentation. For the illustrated lid 20 of FIG. 13, in the example where the circular region 21 has a diameter of 68 mm, the rigidifying indentation 50 is positioned with its mid-point 1.9 mm from the peripheral edge 37.

The rigidifying indentation 50 may have the same geometry in cross-section as described above, for example as shown in FIG. 3, i.e. U- or V-shaped cross-sectional form, and be formed using the same processes as described above, i.e. stamping/pressing or rolling.

In the illustrated example of FIG. 12, the rigidifying indentation 50 protrudes convexly from the outer face 25 of the lid 20. Alternatively the rigidifying indentation 50 can be configured to protrude convexly from the inner face 26 of the lid 20.

The rigidifying indentation 50 may have a height h from 400 to 3000 microns, preferably 600 to 1000 microns. In the illustrated example the height h is 700 microns.

The rigidifying indentation 50 may have a width w up to 5% of the nominal dimension 36 of the lid 20. In one example the width w is from 400 to 5000 microns, preferably from 1500 to 2500 microns. In the illustrated example the width w is 1900 microns.

In the lid 20 of FIG. 13, the rigidifying indentation 50 is in the form of a closed curve which is continuous. By 'closed' is meant that the rigidifying indentation 50 extends around the full periphery of the lid 20. By 'continuous' is meant that the rigidifying indentation 50 has no breaks therein along its path. In a non-illustrated alternative the rigidifying indentation 50 may be a closed curve that is discontinuous by, for example, by having provided a plurality of gaps along the path of the rigidifying indentation. Thus, the rigidifying indentation would have a 'dashed-line' appearance.

Once formed, the lids 20 may be handled more easily as the lids 20 are more resistant to curling and are more likely to remain flat or substantially flat in a resting state.

The formed lids 20 may be stored and/or transferred in a stack of similar lids 20. The lids 2 may be held in a magazine. The rigidifying indentation 50 may also act as a nesting feature to promote better stacking of the lids 20. The increased rigidity of each lid 20 allows for easier removal of each lid 20 from the stack of lids 20, for example using a vacuum cup device since it is more likely that the outer face 25 (or inner face 26 depending on orientation of the lids 20) presented to the vacuum cup will be flat enough for the vacuum cup create a sufficient seal. In addition, the form of the rigidifying indentation 50 does not increase the force required to pick each lid 20 from the stack.

The lidding process involves the steps of transferring the lid 20 into engagement with the container 1 and sealing the lid 20 to the container 1 so as to close the open mouth 11 as described above.

Preferably the rigidifying indentation 50 is located on the lid 20 and the lid 20 is engaged with the container 1 such that the rigidifying indentation 50 is aligned above the flange 12 of the container 1, as shown in FIG. 12. More preferably, the rigidifying indentation 50 is aligned directly above the flange 12 of the container 1. In a most preferred example the width w of the rigidifying indentation 50 is fully located within the breadth of the flange 12.

The lid 20 may be sealed to the container 1 by a heat-seal tool. The heat-seal tool may act to both press the lid 20 into engagement with the flange 12 and heat the heat-seal layer of the composite sheet material 30 sufficiently to create the required bond between the composite sheet material 30 and the flange 12 of the container 1.

Preferably, the heat-seal tool also flattens the rigidifying indentation 50 during the sealing step. The flattening of the rigidifying indentation 50 may be partial but it is preferred that the rigidifying indentation is fully flattened, as shown in FIG. 14, so as to result in an acceptable appearance and readability of the sealed lid. In addition, the full flattening of the rigidifying indentation 50 results in the sheet material 30 within the width w of the rigidifying indentation contacting and being bonded to the flange 12. Thus, the integrity of the seal is increased compared to an arrangement where a part of the sheet material 30 within the breadth of the flange 12 is not sealed to the flange 12.

Figure 15:
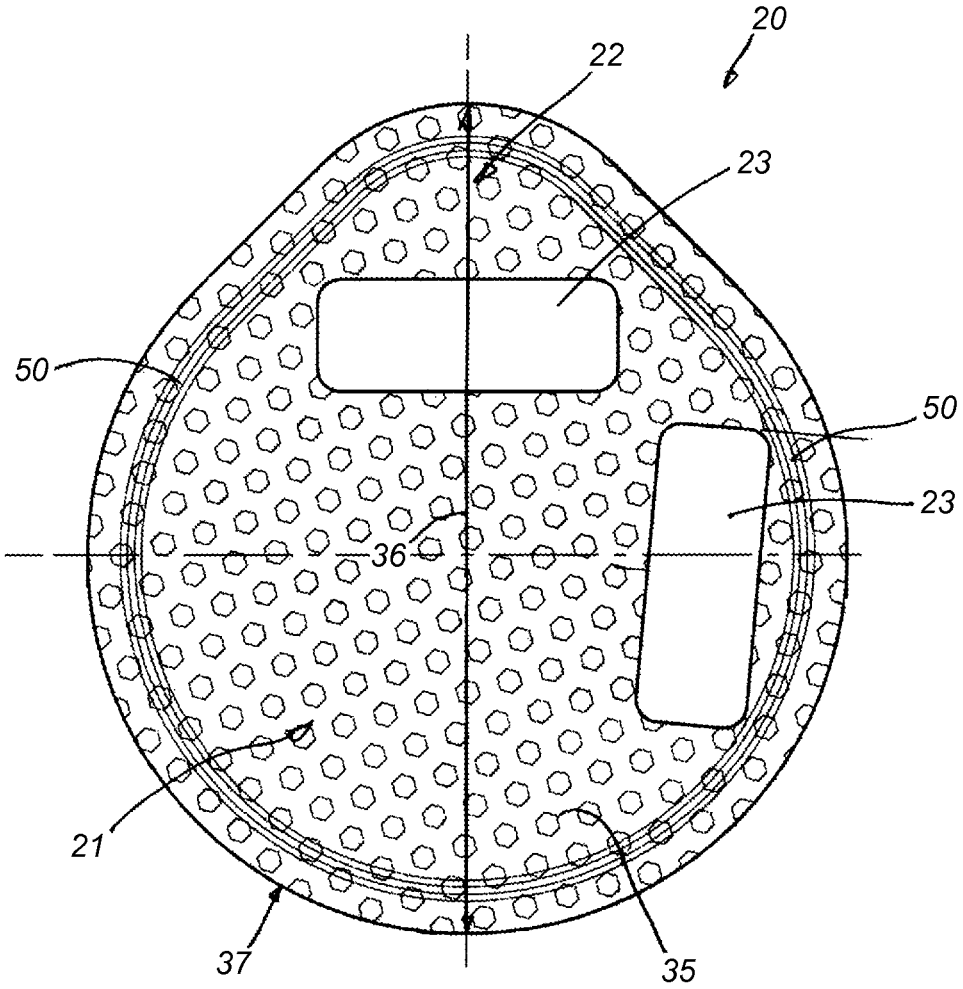
FIG. 15 is a plan view of another lid.
Figure 16:
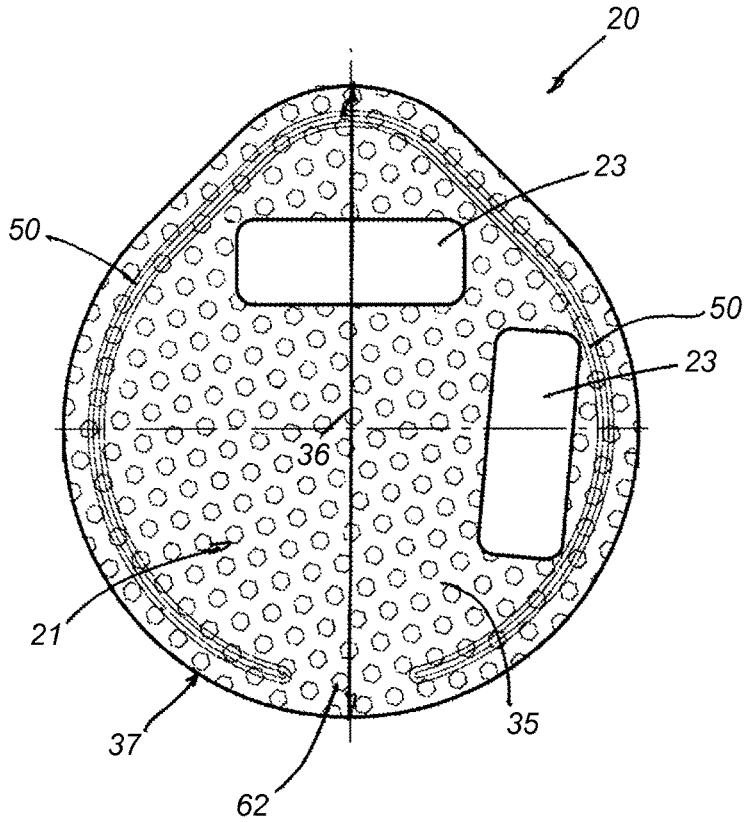
FIG. 16 is a plan view of another lid.
Figure 17:
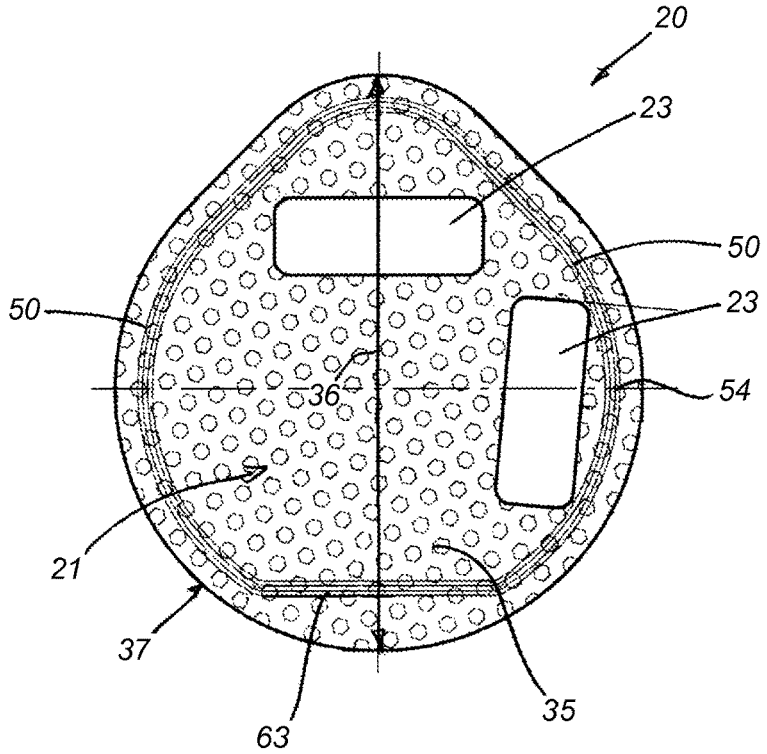
FIG. 17 is a plan view of another lid.

FIGS. 15 to 17 illustrate further examples of lid 20. In the following description only the differences between the lids and the lid of FIG. 13 will be described in detail. In other respects, the lids 20 may be as described above. This includes, for example, the materials of the lid 20 and the method of forming the rigidifying indentation 50. Like reference numerals have been used for like features. In addition, the following embodiments of lid 20 may all be combined with the various types of container 1 as described above. The skilled reader will also appreciate that the features of each example may be combined with features of any other example unless the context explicitly excludes such combination.

FIG. 15 shows a lid 20 which differs in that the rigidifying indentation 50 is located further away from the peripheral edge 37 than in the lid 20 of FIG. 13 while still being within the peripheral region 38 of the lid 20. For the illustrated lid 20 of FIG. 15, in the example where the circular region 21 has a diameter of 68 mm, the rigidifying indentation 50 is positioned with its mid-point 3.9 mm from the peripheral edge 37. This results in the rigidifying indentation 50 being aligned above the annular void space 14 of the body 10 during the sealing process. During the step of flattening the rigidifying indentation 50 with the heat-seal tool, the support from the adjacent flange 12 and rim 16 is sufficient to allow the rigidifying indentation 50 to be flattened without tearing of the sheet material 30.

FIG. 16 shows a lid 20 which differs from the lid 20 of FIG. 13 in that the rigidifying indentation 50 is in the form of an open curve which is continuous. By 'open' is meant that the rigidifying indentation 50 comprises a substantial gap 62 in its length so that it does not extend around the full periphery of the lid 20. The substantial gap 62 may be provided where the body 10 underlying the lid 20 comprises a feature, e.g. a void space, which would prevent effective flattening of the rigidifying indentation 50 by the heat-seal tool. As in the above example, in a non-illustrated alternative the rigidifying indentation 50 may also be discontinuous as well as possessing the substantial gap 62.

FIG. 17 shows a lid 20 which differs from the lid 20 of FIG. 13 in that the rigidifying indentation 50 is still a closed curve but comprises of a curved segment 54 and a straight segment 63.

The invention claimed is:

1. A die-cut lid for closing a container, the lid comprising:

a planar element formed from a flexible composite sheet material and having at least an outer face and an inner face, the outer face and the inner face being formed of different materials;

a functional area bearing human-readable and/or machine-readable data on the outer face;

one or more rigidifying indentations to promote flatness of the functional area in a resting state of the lid;

wherein the one or more rigidifying indentations are one or more encircling indentations that border the functional area;

wherein the one or more rigidifying indentations are formed from the flexible composite sheet material and are arched to protrude convexly from the outer face of the lid, such that a corresponding recess is formed in the inner face of the of the lid;

wherein the composite sheet material has embossing over at least a major portion of the lid;

wherein the embossing is located outwardly relative to the one or more rigidifying indentations that border the functional area; and wherein the the one or more rigidifying indentations comprise a plurality of encircling indentations with at least a first encircling indentation bordering the functional area and a second encircling indentation located proximate a periphery of the lid and extending around the periphery of the lid.

2. A die-cut lid as claimed in claim 1, wherein the functional area bears a barcode.

3. A die-cut lid as claimed in claim 1, wherein the one or more rigidifying indentations comprise a continuous encircling indentation that fully encircles the functional area.

4. A die-cut lid as claimed in claim 1, wherein the one or more rigidifying indentations comprise one or more discontinuous encircling indentations that partially or fully encircles the functional area.

5. A die-cut lid as claimed in claim 1, wherein the one or more rigidifying indentations comprise a plurality of encircling indentations with at least a first encircling indentation bordering the functional area and a second encircling indentation located concentric to the first encircling indentation.

6. A die-cut lid as claimed in claim 1, wherein the functional area comprises less than 70% of the lid.

7. A die-cut lid as claimed in claim 1, wherein the lid has a nominal dimension, being the largest dimension of the lid, and the height of the one or more rigidifying indentations measured perpendicular to the plane of the lid is up to 3% of the nominal dimension.

8. A die-cut lid as claimed in claim 1, wherein the one or more rigidifying indentations have a height measured perpendicular to the plane of the lid of from 400 to 3000 microns.

9. A die-cut lid as claimed in claim 1, wherein the flexible composite sheet material prior to forming the lid has a thickness of from 40 to 100 microns.

10. A die-cut lid as claimed in claim 1, wherein the composite sheet material has an embossed thickness of up to 200 microns.

11. A die-cut lid as claimed in claim 1, wherein the one or more encircling indentations have a U- or V-shaped cross-sectional form.

12. A die-cut lid as claimed in claim 11, wherein the lid has a nominal dimension, being the largest dimension of the lid, and the width of the one or more encircling indentations is up to 5% of the nominal dimension.

13. A die-cut lid as claimed in claim 12, wherein the width of the one or more encircling indentations is from 400 to 5000 microns.

14. A die-cut lid as claimed in claim 1, wherein the flexible composite sheet material comprises an aluminium layer and/or a metallised layer.

15. A die-cut lid as claimed in claim 1, wherein the flexible composite sheet material comprises one or more polymer layers.

16. A die-cut lid as claimed in claim 15, wherein the one or more polymer layers are selected from the group of a polypropylene (PP) layer and a polyethylene terephthalate (PET) layer.

17. A die-cut lid as claimed in claim 16, wherein the flexible composite sheet material comprises a polypropylene layer, an aluminium layer and a polyethylene terephthalate (PET) layer.

18. A die-cut lid as claimed in claim 1, wherein the functional area is provided in a form of a barcode that is printed on an outer face of the lid.

19. A die-cut lid as claimed in claim 1, wherein the flexible composite sheet material that forms the planar element of the lid is continuous.

20. A lidded container comprising a body having an open mouth and a lid which is sealed to the body so as to close the open mouth of the body to define an interior of the lidded container, wherein the lid is a die-cut lid as claimed in claim 1.

21. A lidded container as claimed in claim 20, wherein the functional area is located above the open mouth of the body.

22. A lidded container as claimed in claim 20, wherein the container is a beverage capsule or container, a yogurt pot, a pudding cup, a beverage cup, a gum or candy container, or a food tub.

23. A method of forming the die-cut lid of claim 1, comprising the steps of:

a) providing the flexible composite sheet material;

b) printing human-readable and/or machine-readable data on the flexible composite sheet material; and c) forming the one or more rigidifying indentations to promote flatness of a functional area encompassing said human-readable and/or machine-readable data.

24. The method of claim 23, further comprising forming the embossing prior to step c).

25. The method of claim 23, wherein the one or more rigidifying indentations are formed by stamping/pressing or rolling.

26. The method of forming a die-cut lid according to claim 23, comprising the step of die-cutting the flexible composite sheet material to form the lid.

* * * * *